United States Patent [19]

Katchka

[11] 4,360,338

[45] Nov. 23, 1982

[54] CONTROL SYSTEM FOR DUAL COIL PILOT VALVE BURNER SYSTEM

[75] Inventor: Jay R. Katchka, Cypress, Calif.

[73] Assignee: Robertshaw Controls Company, Richmond, Va.

[21] Appl. No.: 150,940

[22] Filed: May 19, 1980

[51] Int. Cl.[3] ..... F23Q 9/08

[52] U.S. Cl. ..... 431/46; 431/42; 431/43; 431/53

[58] Field of Search ..... 431/46, 42, 45, 53, 431/54, 55, 69, 80, 75, 85, 259, 43

[56] References Cited

U.S. PATENT DOCUMENTS

| | | | |
|---|---|---|---|
| 2,269,157 | 1/1942 | Levine | 431/46 |
| 2,755,852 | 7/1956 | Andrews et al. | 431/46 X |
| 4,077,762 | 3/1978 | Matthews | 431/43 X |
| 4,106,889 | 8/1978 | Katchka | 431/46 |
| 4,255,118 | 3/1981 | Katchka | 431/53 X |
| 4,289,476 | 9/1981 | Visos et al. | 431/46 X |

*Primary Examiner*—Larry Jones

*Attorney, Agent, or Firm*—Fulwider, Patton, Rieber, Lee & Utecht

[57] ABSTRACT

There is disclosed a control system for a gas burner appliance having an interrupted pilot burner operation. The system employs serially-connected first and second (main) electromagnetic operated valves. The first valve has a dual coil construction with a hold coil which can retain the pilot valve open and a pick coil which, acting in concert with the hold coil, can move the first valve to its open position. The control system utilizes one double pole, double throw relay in circuit with a lockout switch, the voltage source, the thermostat switch, and the cold switch contact of the flame switch. The igniter and pick coil are in circuit to the normally open contact of the relay thus being deenergized after a flame is detected at the pilot burner. The coil of the main gas valve is in circuit with the voltage source, the thermostat switch, the normally closed contact of the relay and the hot contact of the flame switch. The hold coil of the first valve is in circuit with the voltage source and the thermostat switch. The system is also provided with a serially-connected lockout switch with its heater in the relay coil circuit. A protective fuse and fuse blowing circuit is also provided.

10 Claims, 2 Drawing Figures

CONTROL SYSTEM FOR DUAL COIL PILOT VALVE BURNER SYSTEM

BACKGROUND OF THE INVENTION

In my prior patent, U.S. Pat. No. 4,106,889, I disclosed a relay control circuit for gas appliances having interrupted pilot burner operations. The circuit disclosed in the aforesaid patent avoided solid state components in the safety circuit and provided an enhanced reliability and safety over systems using solid state devices in this circuit. The circuit of the aforesaid patent included a protective or lockout switch to provide a 100% system shutoff upon failure to establish a pilot burner flame. This circuit, however, employed three relays and a number of additional electrical components.

BRIEF DESCRIPTION OF THE INVENTION

This invention comprises a control system for a gas burner appliance having an interrupted pilot burner operation. The control system provides 100% system shutoff of all gas and electricity in the event that pilot burner flame is not established within a predetermined period of time after initiation of the ignition cycle, the system goes to lockout, and requires manual resetting of the lockout switch. The control system minimizes the number of component parts, thereby providing enhanced reliability and simplifying manufacturing and maintenance. To this end, the first valve of the system is provided with hold and pick coils; the hold coil having sufficient force only to retain the first valve open and the pick coil having sufficient force, in concert with the hold coil to move the first valve into its open position. The control system includes the aforementioned valve which is serially connected with the main gas valve. A thermostat is provided for remote location and a temperature responsive flame switch is positioned adjacent the pilot burner to be responsive to a flame at the pilot burner. A single relay is provided, in circuit to the thermostat, the heater of the lockout switch, and the cold pole of the flame switch. The normally open contacts of the relay are connected in an ignition circuit which includes the ignition means and the pick coil of the first valve whereby these components are deenergized once a flame is established at the pilot burner. The coil of the main gas valve is connected in circuit with a normally closed switch contact of the relay and the hot pole of the flame switch, whereby the main valve is only opened upon detection of a flame at the pilot burner. A fuse and a fuse blowing circuit are provided in circuit through the contacts of the flame switch.

BRIEF DESCRIPTION OF THE FIGURES

The invention will be described with reference to the FIGURES, of which.

DESCRIPTION OF PREFERRED EMBODIMENTS

Figures 1, 2:
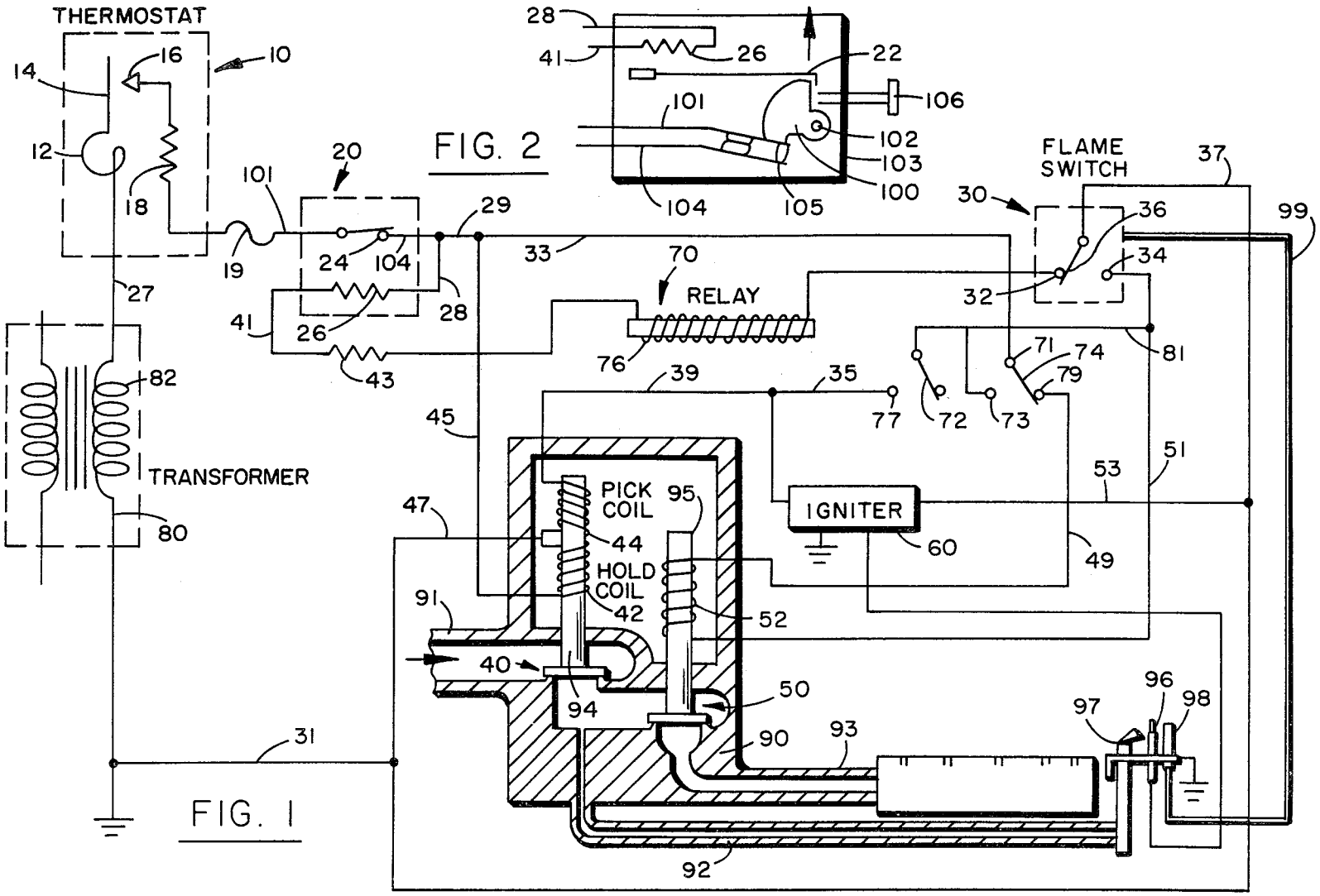
FIG. 1 is an electric schematic of the control system of the invention and also shows the valve arrangement.
FIG. 2 is a schematic of the lock out switch.

Referring now to the drawing figures, the invention will be described with reference to the electrical schematic drawing there shown. The circuit includes a condition sensing switch means 10, typically a room thermostat, a protective lockout switch 20, a combustion detection (flame) switch 30, a first gas valve 40, a second, or main, gas valve 50, an igniter 60, a relay 70, and a voltage source such as a transformer 80. The aforementioned elements have a construction and are connected in the system according to the invention to achieve a remarkable performance with few components.

The condition sensing means 10 can be a conventional thermostat having a bi-metallic helical spring operator 12 to move a switch lever 14 against a fixed position contact 16. The thermostat can also have a conventional resistance heater 18 which serves as an anticipator. A fuse 19 is connected in circuit with the thermostat, between the thermostat and the lockout switch 20. The lockout switch 20 is depicted generally in FIG. 1 and in detail in FIG. 2. As shown in FIG. 2, the preferred lockout switch has contacts on spring members 101 and 104 which are operated by a manually settable latch 100 engaged by button 106. A conventional bimetal lever 22 holds the latch in a closed contact position until the bimetal is heated to permit unlatching for an open contact position. A resistive heating element 26 is connected by conductor 28 to the main voltage lead 29 of the circuit. When current flows through resistive heating element 26, the bimetal lever 22 is heated and moves in the direction of the arrow in FIG. 2 and out of engagement with the latch 100. Spring member 101 forces the latch 100 in rotation about pivot 102 to a stop against housing wall 103.

Latch 100 consists of an upper and lower half. Spring 101 bears against the upper half and spring 104 bears against the lower half at tip 105. This tip, being longer, will cause contact separation when both halves are against wall 103.

In operation, with bimetal lever 22 cool and unlatched and blocked from re-latching by rotation of the upper half of latch 100, button 106 must be manually depressed to engage latch 100 with the bimetal lever 22. The lower half of the latch 100 then permits closure of the contacts. When heater 26 heats the lever 22, unlatching occurs and the contacts on spring conductors 101 and 104 separate and stay so until reset.

Flame switch 30, shown in FIG. 1 is a combustion detection switch that has a flame switch sensor 98 that is positioned adjacent the pilot burner of the burner assembly for contact by the pilot burner flame. The combustion detection switch can be any suitable temperature responsive means such as a bimetallic switch, diastat, etc. Of these, a diastat, which comprises a bulb filled with a temperature responsive liquid, is preferred. This switch has a thermal inertia or heat sink and requires a finite time for response to a change condition. With the preferred diastat, the inertia is the heat capacity of the thermally expanding liquid such as mercury. The sensor 98 is connected to the electrical switch itself by a capillary tube 99, as illustrated. The combustion detection switch has a normally closed, cold contact 32 and a normally open, hot contact 34. The switch lever pole 36 of the this switch is in circuit through conductor 37 with the grounded voltage supply lead 31.

The first valve 40, which is a pilot valve, and the second valve 50, which is the main gas supply valve, are illustrated diagrammatically in FIG. 1 as being housed within a valve housing 90 having an inlet tube 91, with a pilot outlet supply tube 92 and a burner outlet supply tube 93. The first valve 40, is a normally closed pilot valve having a spring biased valve operator which urges the valve into its closed position. The valve 40 has an electromagnetic operator with a moveable armature 94 and two coils; a hold coil 42 which generates sufficient electromagnetic force to retain the valve in an open position against the bias of the spring, but insufficient to move the valve and its associated armature from the closed position, and a pick coil 44. The pick coil 44, when operated simultaneously with the hold coil, provides a sufficient force to move the valve from a closed to an open position.

The main valve 50 which is the second of the two serially connected valves in the gas supply line, is also resiliently biased with a spring (not shown) to a normally closed position. The valve has a moveable armature 95 and an operating coil 52 which is operable to open and retain the valve 50 in an open position.

The igniter 60 is a capacitive discharge sparking system. The circuit has a silicon controlled rectifier (SCR) which is gated through a control circuit to supply a discharge to a sparking electrode 96 that is positioned adjacent to the pilot burner 97 for ignition of fuel discharged from the pilot burner.

Relay 70 is a double pole, double throw relay having a first switch 72 and a second switch 74 with a single electromagnetic operator coil 76 and moveable armature therefor.

Transformer 80 is a stepdown transformer having a secondary winding 82 with the appropriate number of turns to supply a low voltage alternating current, typically about 24 volts to the electrical supply lead 27 and 31.

The thermostat 10, fuse 19 and lockout switch 20 are serially connected in the control circuit of the invention.

The invention includes an ignition circuit which is established by conductor 33 which extends to the switch lever pole 71 of relay switch 74. When the switch lever is moved into contact with normally open pole 73 of this switch, electrical continuity is established with the switch pole 73 of the second relay switch 72. Since the switch lever of switch 72 is simultaneously moved into contact with its normally open contact 77, an electrical circuit is established through conductor 35 to the igniter circuit 60 and to ground through conductor 53 and to the pick coil 44 of the pilot valve 40, to ground through conductor 39.

The relay switches 72 and 74 thus provide ignition switch control means for the ignition circuit. Relay coil 76 is in an ignition switch control circuit which includes conductor 28, resistive heating element 26 of the lockout switch 20, conductor 41, a ballast resistor 43, the normally closed cold contact 32 of flame switch 30 and conductor 37 extending to the grounded voltage supply lead 31.

The system of the invention includes a first valve control circuit which includes conductor 45 that extends to the hold coil 42 of the first valve 40 and the conductor 47 extending from the other terminal of the hold coil to the grounded voltage supply lead 31.

The system has a main burner control circuit which includes conductor 33 that extends to the switch lever pole 71 of relay switch 74 and through the normally closed switch pole 79 of the relay switch 74 and conductor 49 to one of the terminals of the coil 52 of main valve 50. The other terminal of the coil is connected by conductor 51 to the normally open, hot contact 34 of flame switch 30 and through the switch lever pole 36 and conductor 37 to the grounded voltage lead 31.

Finally, the system is provided with a fuse blowing circuit to disable the system in the event that the cold and hot contacts of the flame switch are shorted together. The resultant circuit includes conductor 33, the normally open contact 73 of switch 74, conductor 81, the hot contact 34 of flame switch 30 and conductor 37 which extends to the grounded voltage supply lead 31.

The operation of the control system will be described in the following paragraphs.

A heating demand which is sensed by the condition sensing thermostat 10 closes the thermostat contacts and supplies the voltage from the step down transformer 80 to the circuit. The flame switch is at its normally closed, cold contact and closing of the thermostat completes a circuit through the ignition control circuit that includes the lockout switch 20, the lockout switch heater 26, coil 76 of relay 70, ballast resistor 43, the cold contact 32 of flame switch 30 and conductor 37 to the grounded voltage supply lead 31. This circuit moves the switch levers of relay switches 72 and 74 to close circuits through the normally open contacts 77 and 73, respectively of these switches. This results in closing of the ignition circuit that is established through conductor 33, normally open contact 73 of relay switch 74, normally open contact 77 of relay switch 72, conductor 35, ignitor 60 and pick coil 44 of the pilot control valve 40.

Closing of the thermostat contact also establishes a circuit from the voltage supply lead 29 through conductor 45 and the hold coil 42 of the pilot valve.

The hold coil and pick coil of the first valve 40 are effective in moving the valve to an open position, discharging combustible gas from the pilot burner 97. The igniter circuit is effective in ignition of the gas discharged from the pilot burner to establish a flame at the pilot burner. The pilot burner flame heats the flame switch 30 and after a prescribed period of time, the flame switch breaks contact with the cold contact 32, opening the ignition control circuit through the relay coil 76. The switch levers of switches 72 and 74 move away from the normally open contacts, thereby opening the ignition circuit and disabling further igniter circuit operation and interrupting the current flow through one pick coil 44 of the pilot valve 40. The circuit through the hold coil 42 of the pilot valve, however, remains closed and the hold coil is effective in retaining the pilot valve in its open position.

The second switch 74 of relay 70 closes to the normally closed contact 79 and completes one side of the circuit to coil 52 of the main gas valve 50. When the switch lever of the flame switch 30 moves sufficiently to close contact with the normally open, hot contact 34 of flame switch 30, the main burner control circuit is closed through the coil 52 and through conductor 37 to the grounded voltage supply lead 31, opening the normally closed, main burner control valve.

In the event that the flame switch 30 is unable to prove the establishment of a flame at the pilot burner within a preset period of time, the circuit is provided with a disabling function. This function is provided by the lockout switch 20 since the resistive heating element 26 of this switch is in the ignition control circuit through the relay coil 76. This ignition control circuit is closed from the instant of closing of the thermostat contacts until opening of the circuit at the flame switch cold contact 32. In the event that the flame switch sensing element is not heated sufficiently by a flame at the pilot burner within a predetermined period of time, the resistive heating element 26 is effective to open the circuit at its normally closed contacts. The resistive heating element 26 is provided with a sufficient heat release to provide a predetermined ignition period, e.g., from about 90 to 180 seconds before the lockout switch 20 will be opened, disabling the circuit. The lockout switch remains in the open or locked out position until manually reset by an operator.

In the event that an open circuit failure occurs in the lockout heater 26, the system remains inoperative since all electrical circuits except the circuit through the hold coil 42 of the first valve 40 remain open. The hold coil 42, however, can not, alone, open the first valve and the pick coil 44 will remain deenergized since its operation depends on the ignition circuit which is under control of the ignition switch control circuit which includes the inoperative lockout heater.

In the event that the relay 70 fails to operate, the ignition circuit remains open and no pilot gas can be supplied and the igniter is disabled. Accordingly, the control system will prevent any delivery of combustible gas to the appliance and, within the preset time of the lockout switch, the latter will open and disable the entire circuit.

In the event that the electrical supply current should be interrupted during a heating cycle, the voltage supply to the operating coils of the first and main valves will be interrupted and these valves will go to their normally closed position, extinguishing the flames at the pilot and main burner. The circuit will automatically reset to restart the ignition sequence upon restoration of the electrical supply.

In the event that fuel supply to the burners is interrupted, the flame at the pilot burner will be extinguished which will permit the flame switch to cool sufficiently to leave its normally open hot contact 34, opening the circuit through the coil 52 of the main valve and permitting this valve to close. This will occur within a relatively short time, e.g., within approximately 30 seconds after extinguishment of the pilot burner flame. The circuit will not immediately be restored to a restart position since a finite time is required for the flame switch to cool sufficiently to close contact with its normally closed cold contact 32. This period of time can be from about 5 to about 15 seconds and is normally sufficient to provide adequate time for venting of any combustible which may have, in the interim period, been discharged into the appliance.

In the event that the cold and hot flame switch contacts are shorted together, e.g., by improper installation, the fuse blowing circuit provides a direct short to ground and the circuit is immediately disabled by blowing of fuse 19. The fuse blowing circuit is through thermostat 10, fuse 19, lockout switch 20, relay contacts 71 and 73, flame switch contact 34 and conductors 37 and 31.

The system as thus described, provides a 100% gas shutoff capability with a minimal number of component parts. This provides a circuit with attractive manufacturing cost and additionally, with a greater reliability than the prior circuits of more complexity and/or more failure prone components such as solid state elements.

The invention has been described with reference to the illustrated and presently preferred embodiment. It is not intended that the invention be unduly limited by this description of the illustrated and preferred embodiment. Instead, it is intended that the invention be defined by the means, and their obvious equivalents, set forth in the following claims:

What is claimed is:

1. An ignition and control system for ignition of fuel discharged from a burner assembly including a main fuel burner having a fuel supply line connected thereto, a pilot burner to ignite fuel discharged from said main burner, and a pilot fuel supply line extending to said pilot burner, said system comprising:

ignition means to ignite fuel discharged from said pilot burner;

a normally closed main gas valve and an electromagnetic main coil energizable to open said main gas valve;

a normally closed pilot gas valve and electromagnetic pick and hold coils energizable to open said pilot gas valve;

condition sensing switch means for connection in circuit to a voltage source;

lockout switch means including a lockout switch which in a closed position is in circuit with said condition sensing switch means, and further including heating means in circuit with said condition sensing switch means in said closed position of said lockout switch, said heating means being operative upon prolonged energization of said heating means to move said lockout switch to an open position to open the circuit to said condition sensing switch means, said lockout switch in its closed position being in circuit with said hold coil for energization thereof;

combustion detection switch means having a cold switch pole, a hot switch pole in circuit with said main coil of said main gas valve, and a combustion detection switch engaging said cold switch pole, in circuit with said lockout switch, and responsive to the presence of a flame at said pilot burner to move from said cold switch pole to said hot switch pole for opening said main burner; and ignition switch control means including switch actuating means in circuit with said heating means and said cold switch pole, and further including ignition switch means operative upon energization of said switch actuating means to connect said pick coil in circuit with said lockout switch in said closed position of said lockout switch for opening said pilot gas valve in conjunction with said hold coil and for connecting said ignition means in circuit with said lockout switch in said closed position of said lockout switch whereby fuel discharged from said pilot burner can be ignited, the absence of ignition of said fuel discharged from said pilot burner resulting in said prolonged energization of said heating means and movement of said lockout switch to said open position.

2. A system of claim 1 wherein said switch actuating means of said ignition switch control means comprises a relay coil.

3. The system of claim 1 wherein said ignition means and said pick coil are in parallel circuits with said lockout switch in said closed position of said lockout switch.

4. The system of claim 1 wherein said ignition switch means includes first and second switch means in circuit, respectively, with said hot switch pole and said lockout switch in said closed position of said lockout switch whereby engagement of said hot switch pole by said combustion detection switch effects energization of said main coil.

5. The system of claim 1 including fuse means in circuit with said condition sensing switch means and said second switch means.

6. The system of claim 1 wherein said condition sensing switch means is a thermostatic switch having a temperature responsive switch operator.

7. The system of claim 6 wherein said thermostatic switch includes anticipator heater means connected in circuit with said lockout switch.

8. The system of claim 1 wherein said hold coil is constructed such that energization of said hold coil without accompanying energization of said pick coil is ineffective to open said pilot gas valve.

9. The system of claim 1 wherein said prolonged energization of said heating means is approximately 90 to 180 seconds.

10. The system of claim 1 wherein said lockout switch means includes latching means for releasably holding said lockout switch in said open position subsequent said prolonged energization of said heating means.

* * * * *